US008953971B2

(12) United States Patent
Hayashi et al.

(10) Patent No.: US 8,953,971 B2
(45) Date of Patent: Feb. 10, 2015

(54) IMAGE FORMING APPARATUS

(71) Applicant: KYOCERA Document Solutions Inc., Osaka (JP)

(72) Inventors: Koichi Hayashi, Osaka (JP); Shigeki Tsukahara, Osaka (JP); Masaki Kadota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 21 days.

(21) Appl. No.: 13/940,565

(22) Filed: Jul. 12, 2013

(65) Prior Publication Data

US 2014/0023392 A1 Jan. 23, 2014

(30) Foreign Application Priority Data

Jul. 19, 2012 (JP) ..... 2012-160677

(51) Int. Cl.
*G03G 15/02* (2006.01)

(52) U.S. Cl.
CPC .... *G03G 15/0225* (2013.01); *G03G 2221/1627* (2013.01)
USPC ..... 399/100; 399/176

(58) Field of Classification Search
USPC ..... 399/100, 176
See application file for complete search history.

(56) References Cited

U.S. PATENT DOCUMENTS

| | | | | |
|---|---|---|---|---|
| 3,969,785 | A * | 7/1976 | Ogawa et al. | 15/301 |
| 5,133,915 | A * | 7/1992 | Metten et al. | 264/162 |
| 7,068,960 | B2 * | 6/2006 | Mizusawa | 399/100 |
| 7,715,750 | B2 * | 5/2010 | Kagawa | 399/100 |
| 7,983,587 | B2 * | 7/2011 | Imaizumi | 399/100 |
| 2003/0044196 | A1 * | 3/2003 | Amemiya et al. | 399/100 |
| 2005/0019057 | A1 * | 1/2005 | Mizusawa | 399/100 |
| 2006/0099005 | A1 * | 5/2006 | Kitazawa et al. | 399/100 |
| 2007/0189801 | A1 * | 8/2007 | Miyaji et al. | 399/100 |
| 2008/0075499 | A1 * | 3/2008 | Handa et al. | 399/100 |
| 2008/0292354 | A1 * | 11/2008 | Shinkawa et al. | 399/100 |
| 2009/0208239 | A1 * | 8/2009 | Kamoshida et al. | 399/100 |
| 2010/0119251 | A1 * | 5/2010 | Miyamoto | 399/100 |
| 2010/0247135 | A1 * | 9/2010 | Imaizumi | 399/100 |
| 2011/0002711 | A1 * | 1/2011 | Wada | 399/176 |
| 2012/0107012 | A1 * | 5/2012 | Amemiya et al. | 399/100 |
| 2012/0213553 | A1 * | 8/2012 | Hoshio | 399/176 |

FOREIGN PATENT DOCUMENTS

| | | | |
|---|---|---|---|
| JP | 2009-265234 | A | 11/2009 |
| JP | 2010-190931 | A | 9/2010 |

OTHER PUBLICATIONS

The extended European search report issued on Jan. 9, 2014, which corresponds to European Patent Application No. 13175474.9-1560 and is related to U.S. Appl. No. 13/940,565.

* cited by examiner

*Primary Examiner* — G. M. Hyder
(74) *Attorney, Agent, or Firm* — Studebaker & Brackett PC

(57) ABSTRACT

An image forming apparatus includes an image carrier, a charge roller, a cleaning brush and a distance changing mechanism. The charge roller includes a surface having protrusions and depressions and to electrically charge the image carrier. The cleaning brush includes a brush part cleaning the surface of the charge roller and a main body part supporting the brush part. The brush part includes a top end part and a belly part being nearer to the main body part than the top end part. The distance changing mechanism changes a distance between the charge roller and main body part so that, by adjusting the distance to a first distance, the top end part contacts with the depression and, by adjusting the distance to a second distance shorter than the first distance, the belly part contacts with the protrusion.

5 Claims, 10 Drawing Sheets

IMAGE FORMING APPARATUS

INCORPORATION BY REFERENCE

This application is based on and claims the benefit of priority from Japanese Patent application No. 2012-160677 filed on Jul. 19, 2012, the entire contents of which are incorporated herein by reference.

BACKGROUND

The present disclosure relates to an image forming apparatus, particularly an image forming apparatus provided with an electric charge roller (a charge roller) electric-charging an image carrier and a cleaning brush cleaning a surface of the charge roller.

An image forming apparatus often uses a charge roller in order to electrically charge a photosensitive drum as an image carrier. With the object of removing a toner (a developer) and an external additive added to the toner adhered on a surface of the charge roller, a cleaning member comes into contact with the charge roller. Generally, as the charge roller, a cleaning brush is used so that a tip (a top end) of the brush part cleans the surface of the charge roller.

As the cleaning brush increased cleaning performance, a brush roller (a cleaning brush) is well-known to prevent bristles from falling and to keep stable cleaning capacity by weave straight brush yarn (the brush part) and half arc-formed brush yarn into a common base fabric.

Moreover, an image forming apparatus is well-known to stabilize following rotation of the cleaning roller and to keep the cleaning performance for a long time by bringing a cleaning roller (the cleaning brush) with a planted bristle brush or the like contact with the charge roller in a low pressure load.

Furthermore, in the image forming apparatus, generally, the charge roller is made come into contact with the photosensitive drum so that the charge roller rotates following the photosensitive drum by rubber performance of the charge roller. On the other hand, in order to response recent requests of high speed and high definition, a way of decreasing electric discharge irregularity of the charge roller is proposed.

FIG. 8 is a schematic diagram schematically showing a photosensitive drum and a charge roller and the periphery in an image forming apparatus possible to decrease electric discharge irregularity of the charge roller. The image forming apparatus includes, as shown in FIG. 8, a photosensitive drum 101, a charge roller 102, a cleaning blade 103 and a cleaning brush 104. The charge roller 102 electrically charges the photosensitive drum 101. The cleaning blade 103 removes a toner and an external additive 110 adhered on a surface of the photosensitive drum 101. The cleaning brush 104 cleans a surface of the charge roller 102.

The surface of the charge roller 102 has electrical conduction and is formed in a slight rugged shape, that is, with slight protrusions and depressions (refer to FIG. 9). Thereby, a lot of slight gaps are arranged in an area S of the charge roller 102 contacted with the photosensitive drum 101. Therefore, electric discharge is caused in upper stream side and lower stream side of the area S in the rotating direction of the charge roller 102, and moreover, local electric discharge is caused in the area S. As a result, the discharged area is increased and the electric discharge irregularity of the charge roller 102 is decreased. Protrusions 102*a* on the surface of the charge roller 102 are, as shown in FIG. 9, rounded so as not to damage the surface of the photosensitive drum 101.

In the image forming apparatus, as shown in FIG. 8, the toner and external additive 110 adhered on the surface of the photosensitive drum 101 are removed by the cleaning blade 103. Then, a part of the toner and external additive 110 pass through the cleaning blade 103 and adhere on the surface of the charge roller 102. The toner and external additive 110 adhered on the surface of the charge roller 102 are removed by tips (top ends) of the cleaning brush 104.

However, in the image forming apparatus as shown in FIG. 8, slight protrusions and depressions are formed on the surface of the charge roller 102. Therefore, as shown in FIG. 10, even if tips (top ends) of the cleaning brush 104 comes into contact with the protrusions 102*a* of the surface of the charge roller 102, they moves to the depressions 102*b*. That is, the cleaning brush 104 is difficult to contact with the protrusions 102*a* of the surface of the charge roller 102. As a result, although the toner and external additive 110 adhered on the depressions 102*b* are removed, it is difficult to remove the toner and external additive 110 adhered on the protrusions 102*a*.

Thus, if the protrusions 102*a* numerously formed on the surface of the charge roller 102 are insufficiently cleaned, the toner and external additive 110 are deposited, and then, the deposits cause variation of resistance to effect a black spot on an image. Because the surface of the charge roller 102 has lots of protrusions 102*a*, if, corresponding to the protrusions 102*a*, the black spots are caused, the image entirely becomes dark as a fog image.

Moreover, if the above-mentioned cleaning brush is used, because tips (top ends) of the cleaning brush move to the depressions of the charge roller 102, the protrusions 102*a* are insufficiently cleaned.

SUMMARY

In accordance with an embodiment of the present disclosure, an image forming apparatus includes an image carrier, a charge roller, a cleaning brush and a distance changing mechanism. The charge roller is configured to include a surface having protrusions and depressions and to electrically charge the image carrier. The cleaning brush is configured to include a brush part cleaning the surface of the charge roller and a main body part supporting the brush part. The brush part includes a top end part and a belly part being nearer to the main body part than the top end part. The distance changing mechanism is configured to change a distance between the charge roller and main body part of the cleaning brush so that, by adjusting the distance between the charge roller and main body part to a first distance, the top end part of the brush part contacts with the depression of the surface of the charge roller and, by adjusting the distance between the charge roller and main body part to a second distance shorter than the first distance, the belly part of the brush part contacts with the protrusion of the surface of the charge roller.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, an embodiment of the present disclosure will be described with reference to the drawings.

Figure 1:
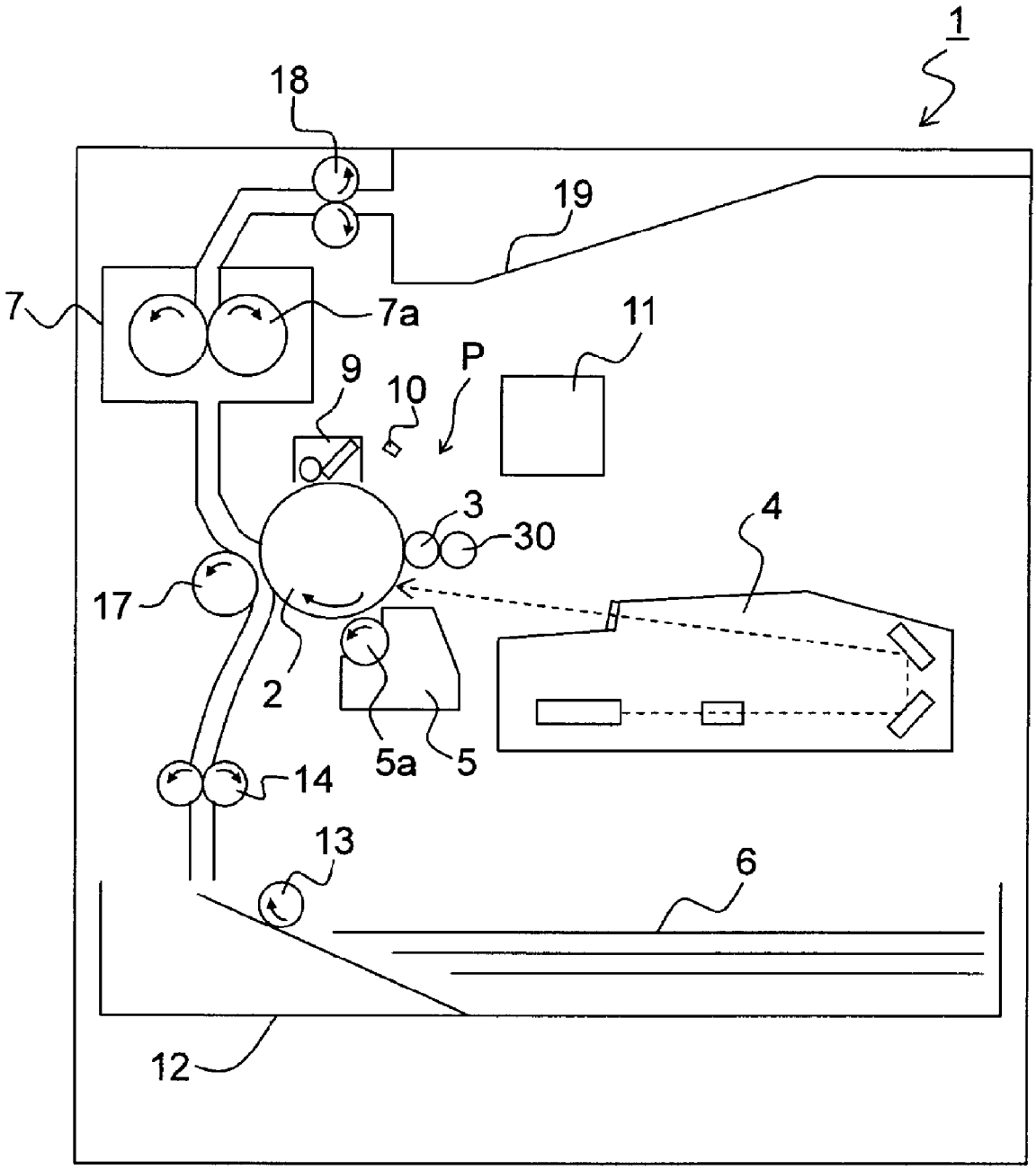
FIG. 1 is a side sectional view schematically showing an image forming apparatus according to an embodiment of the present disclosure.

With reference to FIGS. 1 to 7, an image forming apparatus 1 according to the embodiment of the present disclosure will be described. FIG. 1 is illustrated so that the front side of the image forming apparatus 1 is positioned at the right-hand side. As shown in FIG. 1, in the image forming apparatus 1 (here, a monochrome printer), an image forming part P is arranged. The image forming part P forms a given image by charging, exposing, developing and transferring processes.

In the image forming part P, a photosensitive drum (an image carrier) 2 carrying a visible image (a toner image) is located. The image forming part P is configured so that the toner image formed on the photosensitive drum 2 is transferred to a sheet (a recording medium) 6 and fixed on the sheet 6 by a fixing unit 7, and then, the sheet is ejected from an apparatus main body. During the photosensitive drum 2 is rotated in a clockwise direction in FIG. 1 by a drum driving motor (not shown), an image forming process to the photosensitive drum 2 is carried out.

Next, the image forming part P will be described in detail. In the periphery and a forward side (a right side in FIG. 1) of the rotatably attached photosensitive drum 2, a charge roller 3, an exposure unit 4, a development unit 5, a cleaning device 9 and a static eliminator 10. The charge roller 3 electrically charges the photosensitive drum 2. The exposure unit 4 exposes image information on the photosensitive drum 2. The development unit 5 forms the toner image on the photosensitive drum 2. The cleaning device 9 collects a developer (a toner) remained on the photosensitive drum 2. The static eliminator 10 eliminates an electrostatic latent image.

First, a surface of the photosensitive drum 2 is uniformly electric-charged by the charge roller 3 and exposed by the exposure unit 4 to form the electrostatic latent image corresponding to an image signal on the photosensitive drum 2. The development unit 5 includes a developing roller 5*a* located facing to the photosensitive drum 2 and, in the development unit 5, a positive charged toner having magnetic single-component is filled up by a predetermined quantity by a toner container 11. The toner is supplied by the developing roller 5*a* with development bias added by a development bias adding device (not shown) to the surface of the photosensitive drum 2 and electrostatically adhered there. Thereby, the toner image is formed according to the electrostatic latent image formed by photographic exposure from the exposure unit 4. The charge roller 3 is described below in detail.

The sheet 6 to be transferred with the toner image is stored in a sheet feeding cartridge 12 storing the sheets 6 and conveyed to the photosensitive drum 2 having the formed toner image via a sheet feeding roller 13 and a pair of resist rollers 14. Then, an image writing signal is turned on and an image is formed on the photosensitive drum 2 so that the toner image is transferred to a predetermined position on the sheet 6. In a lower part of the photosensitive drum 2, an electric field is created by a transferring roller 17 to which predetermined transfer bias is added, thereby transferring the toner image on the photosensitive drum 2 to the sheet 6. To the transferring roller 17, negative transfer bias being reverse polarity to the toner is added in image forming (in a printing operation).

The sheet 6 having the transferred toner image is conveyed to the fixing unit 7. In the photosensitive drum 2 after the toner image is transferred, in order to prepare to continuously form new electrostatic latent image, the toner remained on the surface is collected by the cleaning device 9. The sheet 6 conveyed to the fixing unit 7 is heated and pressed by a pair of fixing rollers 7*a*, thereby fixing the toner image to the surface of the sheet 6 to form a given image. The sheet 6 having the formed image is ejected to an ejecting tray 19 by a pair of ejecting rollers 18.

Figure 2:
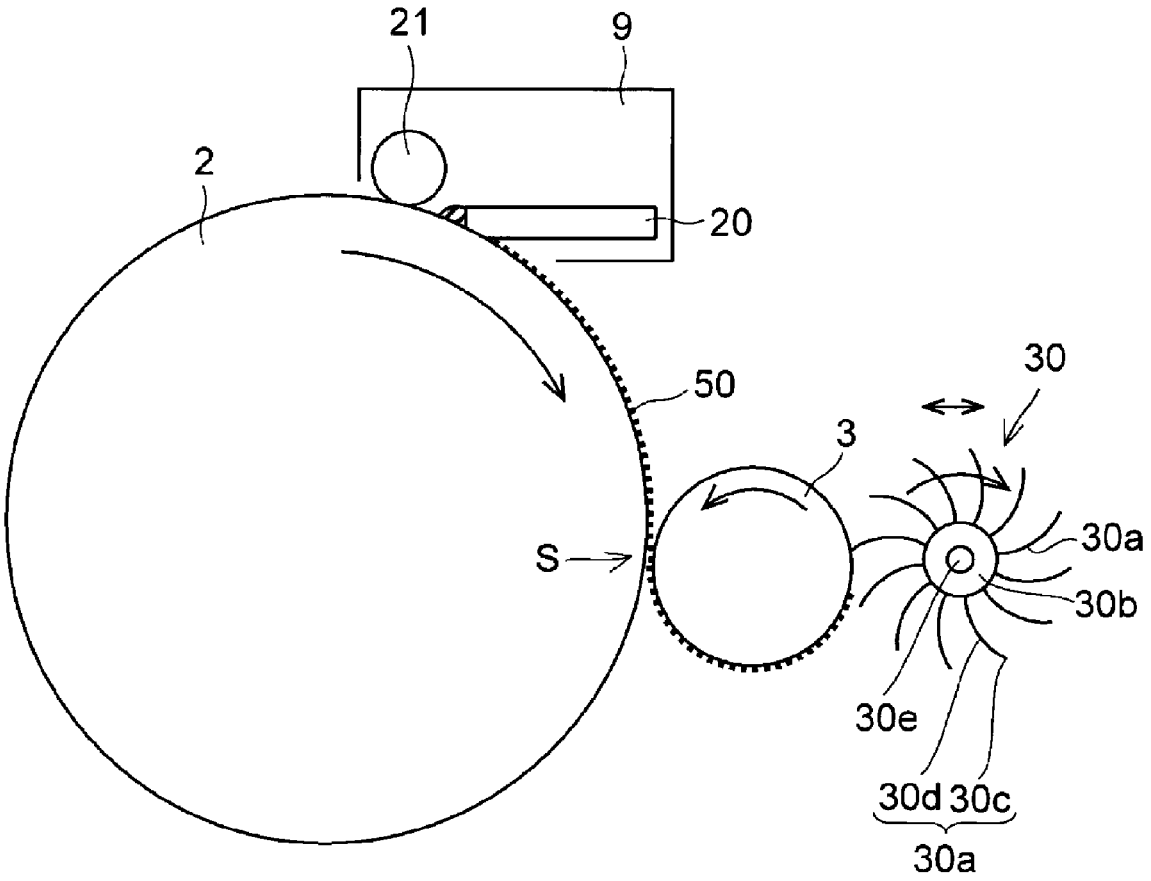
FIG. 2 is a schematic diagram showing a photosensitive drum and a charge roller and the periphery according to the embodiment of the present disclosure.

As shown in FIG. 2, at a side of the photosensitive drum 2, the charge roller 3 is located to rotatably come into contact with the drum surface and to electrically charge the drum surface.

As the photosensitive drum 2, for example, amorphous silicon (a-Si) drum may be used. The photosensitive drum 2 is connected with the above-mentioned drum driving motor via a driving gear (not shown) to rotate in the clockwise direction in the figure as mentioned above.

As the charge roller 3, for example, it is preferable to use a solid type roller, such as an electric conductive rubber roller made by forming a rubber layer (an elastic layer) 3*b* (refer to FIG. 3), e.g. epichlorohydrin rubber, around a metal shaft (a cored bar) 3*a* (refer to FIG. 3), but this is not restricted. Alternatively, for example, a sponge type roller made by covering a foaming rubber roller with a tube may be used.

The charge roller 3 is rotatably supported by the apparatus main body. The charge roller 3 is pressurized to the photosensitive drum 2 by a predetermined nip pressure to rotate by following the photosensitive drum 2. In the image forming (in the printing operation), charge bias having the same polarity (here, the positive polarity) as the toner is added to the charge roller 3.

Concretely, the shaft 3*a* of the charge roller 3 is electrically connected with a power supply (not shown) and the charge bias being superposed alternating current voltage on direct current voltage is supplied from the power supply to the charge roller 3. Such a charge bias is added to flow a current according to resistance of the rubber layer 3*b* of the charge roller 3, thereby charging the surface of the photosensitive drum 2. Alternatively, another direct voltage may be added to the charge roller 3.

Figure 3:
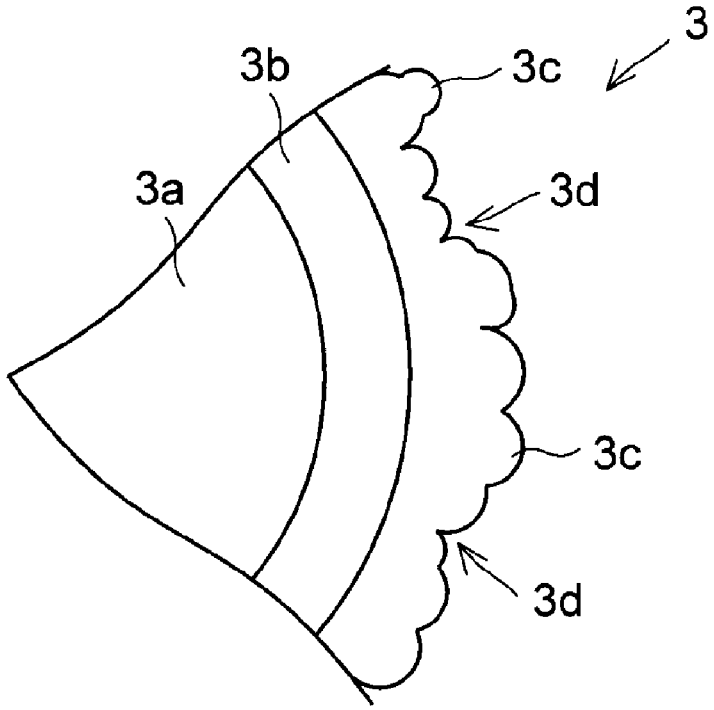
FIG. 3 is a partial enlarged sectional view showing a surface part of the charge roller according to the embodiment of the present disclosure.

To the surface of the charge roller 3 (the surface of the rubber layer 3*b*), as shown in FIG. 3, a binder containing conductive particles (for example, graphite particles) is coated. Thereby, on the surface of the charge roller 3, a slight rugged shape is formed, that is, protrusions 3*c* and depressions 3*d* are numerously formed. Therefore, a lot of slight gaps are arranged in an area S (refer to FIG. 2) of the charge roller 3 contacted with the photosensitive drum 2. As a result, electric discharge is caused in upper stream side and lower stream side of the area S in the rotating direction of the charge roller 3, and moreover, local electric discharge is caused in the area S.

On the surface of the charge roller 3, in a circumferential direction as well as in an axial direction of the charge roller 3, the slight rugged shape is formed. The protrusions 3*c* on the surface of the charge roller 3 are rounded so as not to damage the surface of the photosensitive drum 2. A difference in level between the protrusion and depression on the surface of the charge roller 3 is, for example, approximately 10 micrometers.

The cleaning device 9 includes, as shown in FIG. 2, a cleaning blade 20, a cleaning roller 21 and a collecting screw (not shown) as a toner discharging means. The cleaning blade removes the toner remained on the surface of the photosensitive drum 2. The cleaning roller 21 removes the toner remained on the surface of the photosensitive drum 2 and slides on the surface of the photosensitive drum 2 to grind the surface. The cleaning blade 20 comes into contact with the surface photosensitive drum 2 so as to counter against the rotating direction of the drum (the clockwise direction in FIG. 2).

The remained toner and an external additive added to the toner on the surface of the photosensitive drum 2 are removed by the cleaning blade 20 and discharged from a toner discharging port (not shown) outside the cleaning device 9 by the cleaning roller 21 and collecting screw (not shown). Although an illustration in the figure is omitted, the cleaning device 9 includes a scraper keeping the toner on the surface of the cleaning roller 21 a predetermined layer thickness and an urethane seal preventing waste toner in the cleaning device 9 from leaking outside.

By providing such a cleaning device 9, as mentioned above, almost the remained toner and external additive 50 are removed by the cleaning blade 20, but some toner and external additive 50 are not removed to pass through the cleaning blade 20. Apart of the toner and external additive 50 passed through the cleaning blade 20 remains adhering on the surface of the photosensitive drum 2 to move the lower stream in the rotating direction and adheres on the surface of the charge roller 3.

Because such apart on the surface of the charge roller 3 to which the toner and external additive 50 adhere is different from another part in an electrical potential, if the adhered part were remained, it is feared that a failure of electric charge is caused. As a result, it is feared that a black spot is effected on a formed image to cause an image failure.

In order to remove the toner and external additive 50 causing the failure of electric charge and image failure, a cleaning brush 30 is located in front of the charge roller 3 and pressurized to the surface of the charge roller 3 to clean the roller surface.

The cleaning brush 30 includes brush parts 30*a* cleaning the surface of the charge roller 3 and a main body part 30*b* supporting the brush parts 30*a* and is made in a roller form. The cleaning brush 30 is connected with the above-mentioned drum driving motor via a driving gear (not shown) to rotate in the clockwise direction in the figure. An outside diameter of the cleaning brush 30 is, for example, approximately 11.5 millimeters, a length of the brush part 30*a* is, for example, approximately 3.25 millimeters and an outside diameter (a diameter) of the main body part 30*b* is, for example, approximately 5 millimeters.

The brush part 30*a* includes a top end part 30*c* and a belly part 30*d* being nearer to the main body part 30*b* than the top end part 30*c*. As material of the brush part 30*a*, for example, electric conductive resin material, such as nylon or polyester material may be used. Alternatively, another material having electric conductivity by composing resin material and another electric conductive material may be used.

Figure 4:
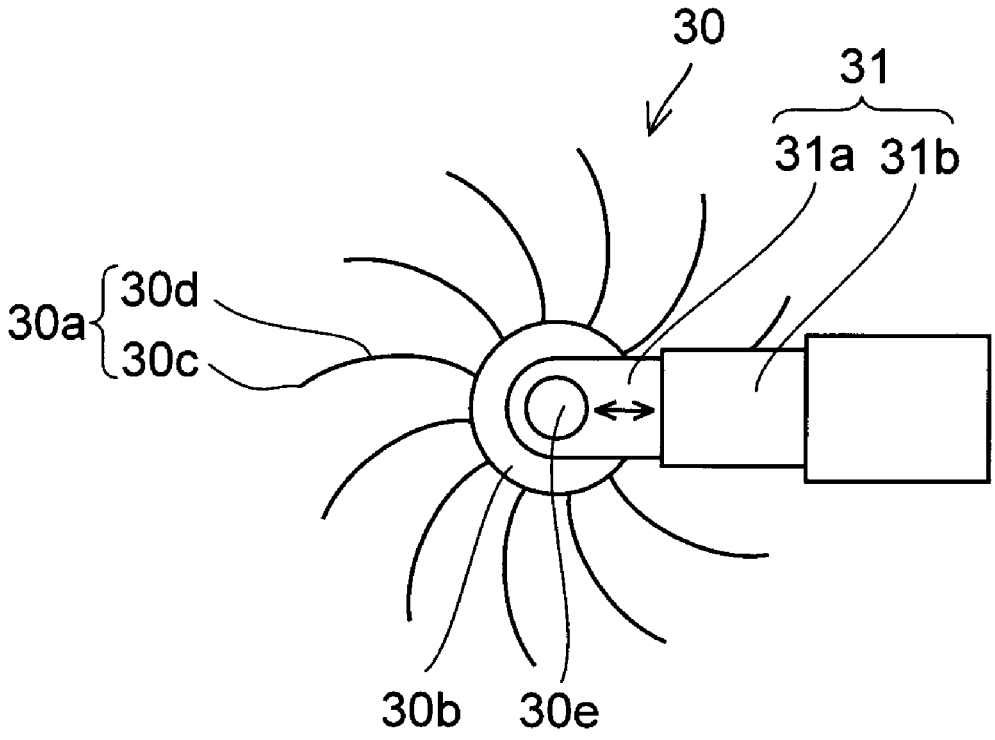
FIG. 4 is a schematic diagram showing a cleaning brush and a distance changing mechanism according to the embodiment of the present disclosure.

A roller shaft 30*e* of the main body part 30*b* is, as shown in FIG. 4, attached to a distance changing mechanism 31 changing a distance between the charge roller 3 and main body part 30*b* of the cleaning brush 30. The distance changing mechanism 31 includes a bearing 31*a* rotatably supporting the roller shaft 30*e* of the main body part 30*b* and a solenoid 31*b* moving the bearing 31*a*.

Figure 5:
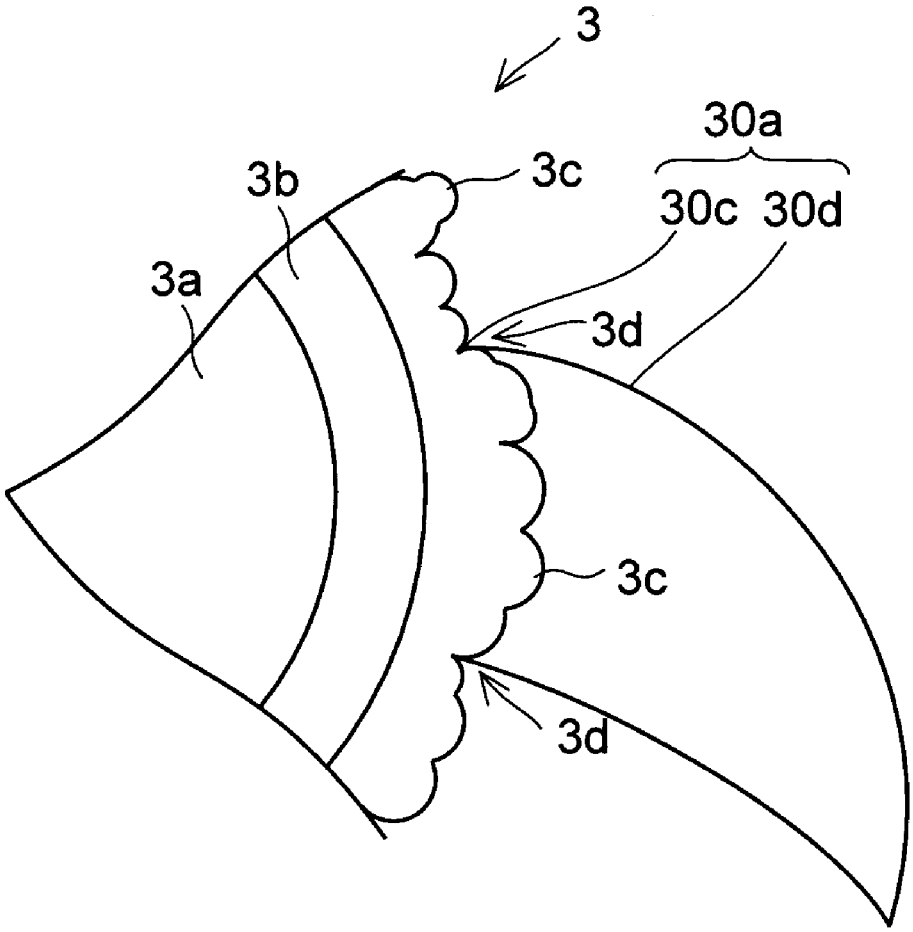
FIG. 5 is a partial enlarged sectional view showing a situation, in which top ends of a brush part contact with depressions of the charge roller, according to the embodiment of the present disclosure.
Figure 6:
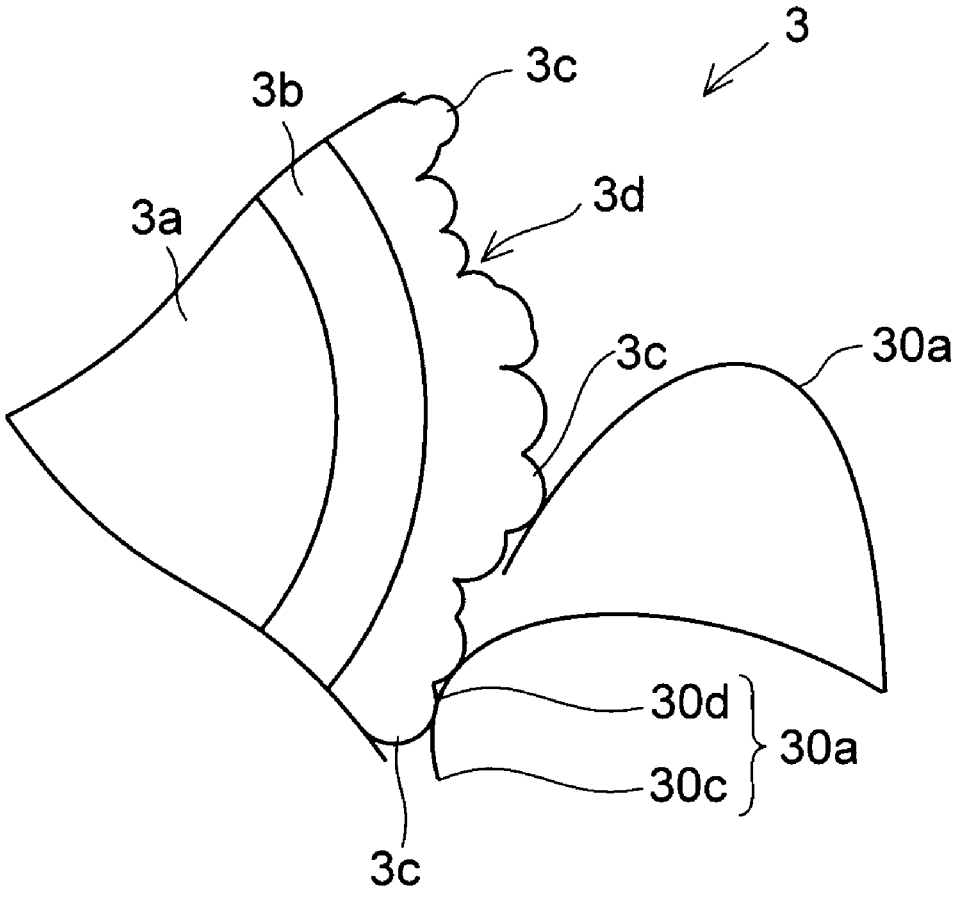
FIG. 6 is a partial enlarged sectional view showing a situation, in which belly parts of the brush part contact with protrusions of the charge roller, according to the embodiment of the present disclosure.

Moreover, the distance changing mechanism 31 is configured to move the cleaning brush 30, thereby adjusting the distance between the charge roller 3 and main body part 30*b* of the cleaning brush 30 to a first distance (reference numeral D1 in FIG. 7) or a second distance (reference numeral D2 in FIG. 7) shorter than the first distance. When the distance changing mechanism 31 adjusts the distance between the charge roller 3 and main body part 30*b* to the first distance, as shown in FIG. 5, the top end part 30*c* of the brush part 30*a* contacts with the depression 3*d* of the surface of the charge roller 3. When the distance changing mechanism 31 adjusts the distance between the charge roller 3 and main body part 30*b* to the second distance, as shown in FIG. 6, the top end part 30*c* of the brush part 30*a* contacts with the protrusion 3*c* of the surface of the charge roller 3.

Concretely, when the distance between the charge roller 3 and main body part 30*b* is adjusted to the first distance, an overlap quantity between the charge roller 3 and cleaning brush 30 becomes approximately 0.5 millimeters. Then, in a slight bending state of the brush part 30*a*, the top end part 30*c* contacts with the depression 3*d*. The overlap quantity is determined by subtracting a distance between a center of the roller shaft of the charge roller 3 and a center of the main body part 30*b* of the cleaning brush 30 from the sum of a radius of the charge roller 3 and a radius of the cleaning brush 30. If the overlap quantity is approximately 0.5 millimeters, the brush part 30*a* is bended so as to shorten by approximately 0.5 millimeters.

In addition, when the distance between the charge roller 3 and main body part 30*b* is adjusted to the second distance, the main body part 30*b* of the cleaning brush 30 is moved to the charge roller 3 side by approximately 1 millimeter and the overlap quantity between the charge roller 3 and cleaning brush 30 becomes approximately 1.5 millimeters. Accordingly, the brush part 30*a* is further bended and the belly part 30*d* contacts with the protrusion 3*c*.

Figure 7:
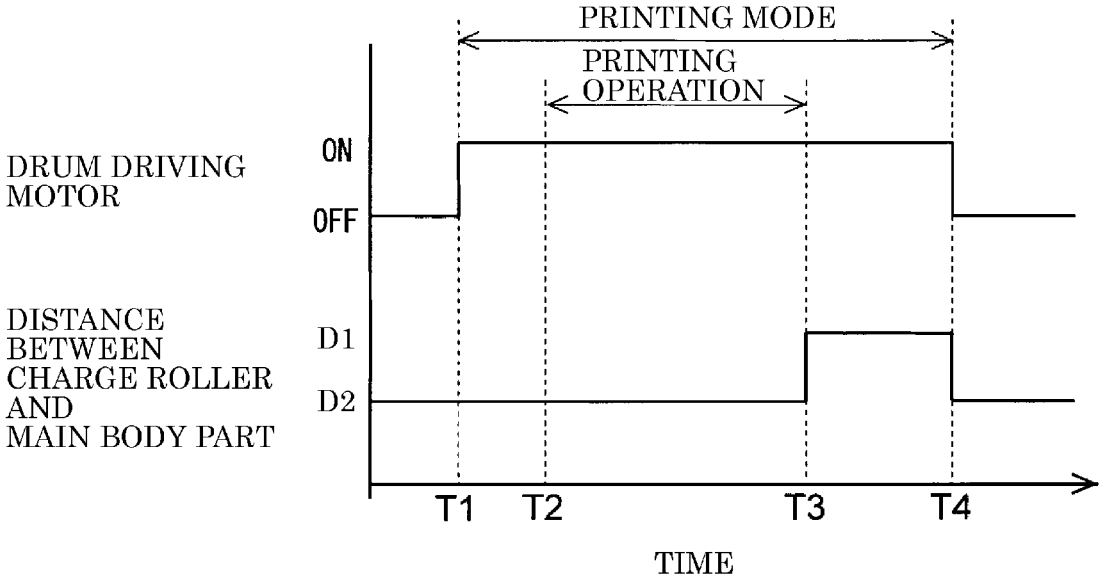
FIG. 7 is a timing chart explaining a cleaning operation of the cleaning brush according to the embodiment of the present disclosure.
Figure 8:
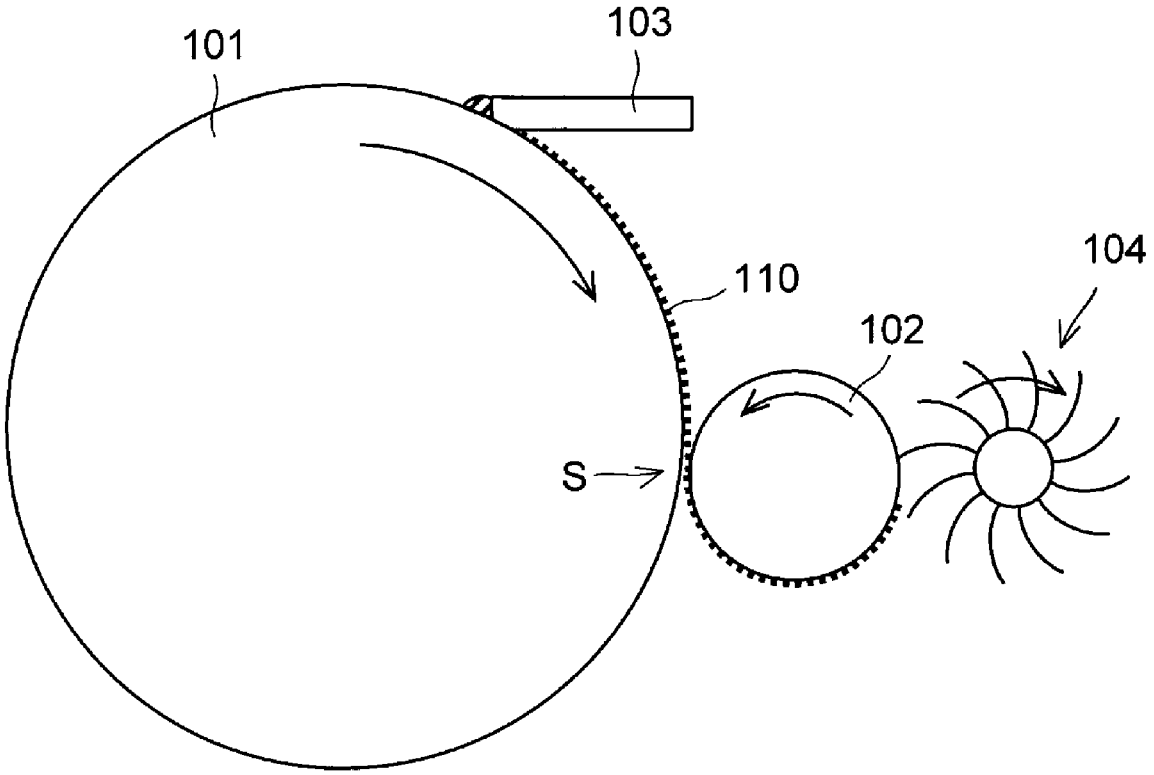
FIG. 8 is a schematic diagram showing a photosensitive drum and a charge roller and the periphery of an image forming apparatus.
Figure 9:
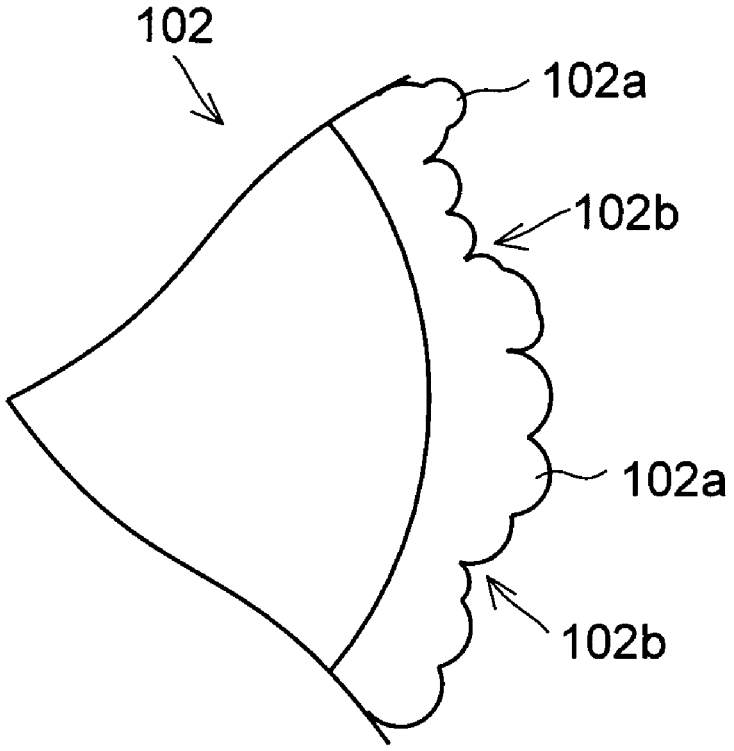
FIG. 9 is a partial enlarged sectional view showing a surface part of the charge roller of an image forming apparatus.
Figure 10:
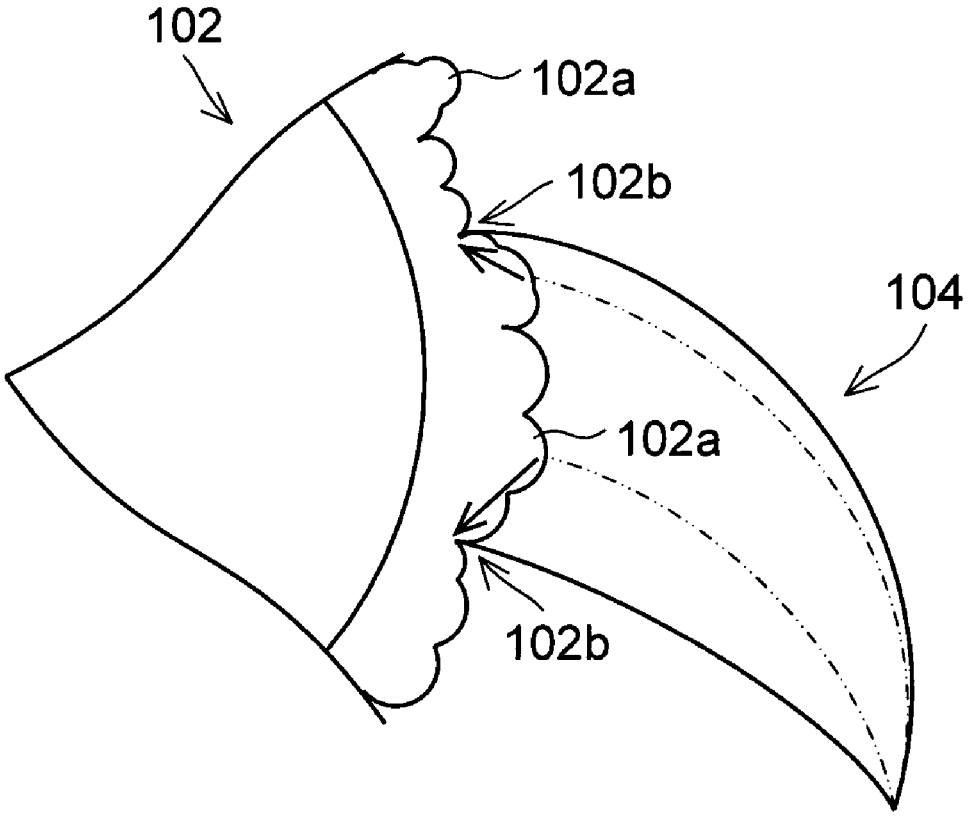
FIG. 10 is a partial enlarged sectional view showing a situation, in which tips (top ends) of a cleaning brush of an image forming apparatus move from protrusions to depressions in a charge roller.

As shown in FIG. 7, when the image forming apparatus 1 becomes a printing mode (time T1), the drive (rotation) of the above-mentioned drum driving motor starts to drive (rotate) the photosensitive drum 2, charge roller 3 and cleaning brush 30. Then, after a predetermined time has passed, a printing operation starts (time T2). In the printing operation, high voltage is added to the charge roller 3 and electric charge is caused to the photosensitive drum 2. In addition, in the printing operation, the distance between the charge roller 3 and main body part 30*b* is adjusted to the first distance, and accordingly, the depression 3*d* of the surface of the charge roller 3 is cleaned by the top end part 30*c* of the brush part 30*a*.

Subsequently, when the printing operation is completed (time T3), the high voltage addition to the charge roller 3 is released. Then, the distance between the charge roller 3 and main body part 30*b* is adjusted to the second distance by the distance changing mechanism 31, and accordingly, the protrusion 30*c* of the surface of the charge roller 3 is cleaned by the belly part 30*d* of the brush part 30*a*.

Then, after another predetermined time has passed, the printing mode is released (time T4) to stop the drum driving motor and to adjust the distance between the charge roller 3 and main body part 30*b* to the first distance.

The above-mentioned operation of the image forming apparatus 1 is performed by a not-shown controller (Central Processing Unit, CPU). With regard to a timing of changing the distance between the charge roller 3 and main body part 30*b* from the first distance to the second distance, the change may be carried out before the completion of the printing operation, but preferably immediately after the completion of the printing operation.

In the image forming apparatus 1 of the embodiment, because the protrusions 3*c* and depressions 3*d* of the charge roller 3 are cleaned, contrary to well-known techniques causing the black spots on an image by printing operations of approximately 100 k, the image failure is not caused even if printing operations of approximately 600 k are carried out. That is, it is possible to lengthen a lifetime of the charge roller 3.

In the embodiment, as mentioned above, by adjusting the distance between the charge roller 3 and main body part 30*b* to the first distance by the distance changing mechanism 31, the top end part 30*c* of the brush part 30*a* contacts with the depression 3*d* of the surface of the charge roller 3. In addition, by adjusting the distance between the charge roller 3 and main body part 30*b* to the second distance by the distance changing mechanism 31, the belly part 30*d* of the brush part 30*a* contacts with the protrusion 3*c* of the surface of the charge roller 3. Thus, by changing the distance between the charge roller 3 and main body part 30*b* by the distance changing mechanism 31, it is possible to clean the depression 3*d* by the top end part 30*c* of the brush part 30*a* and to clean the protrusion 3*c* by the belly part 30*d* of the brush part 30*a*. As a result, it is possible to restrain variation of resistances of the protrusion 3*c* and depression 3*d* on the surface of the charge roller 3, and then, to restrain the black spot from causing on the image. Accordingly, it is possible to restrain the image from entirely becoming dark as a fog image.

As mentioned above, in a non-printing operation (after the printing operation is completed), the distance between the charge roller 3 and main body part 30*b* is changed. Thereby, in the printing operation, it is possible to prevent variation of a load of the cleaning brush 30 to the charge roller 3 from causing variation of a load of the charge roller 3 to the photosensitive drum 2. Accordingly, it is possible to restrain an image failure, such as jitter.

Moreover, as mentioned above, in the printing operation, the distance between the charge roller 3 and main body part 30*b* is adjusted to the first distance and, in the non-printing operation (after the printing operation is completed), the distance between the charge roller 3 and main body part 30*b* is adjusted to the second distance. That is, the depression 3*d* is cleaned in the printing operation and the protrusion 3*c* is cleaned in the non-printing operation. Generally, in the printing mode, because a time of the printing operation is longer than another time of the non-printing operation, a cleaning time of the depression 3*d* is longer than another cleaning time of the protrusion 3*c*. Accordingly, it is possible to intensively clean the depression 3*d* tending to deposit the toner and external additive 50, and therefore, to effectively clean the surface of the charge roller 3.

In addition, as above mentioned, the distance changing mechanism includes the bearing 31*a* supporting the roller shaft 30*e* formed in the main body part 30*b* of the cleaning brush 30 and solenoid 31*b* moving the bearing 31*a*. Thereby, it is possible to easily change the distance between the charge roller 3 and main body part 30*b* of the cleaning brush 30. Moreover, by using the solenoid 31*b*, it is possible to move the cleaning brush 30 regardless of rotation or non-rotation of the photosensitive drum 2 and the charge roller 3.

Although the present embodiment is described as an illustration in all factors, it is not restricted. The scope of the present invention is directed not by the description of the embodiment, but by the claims and includes all variation of the similar spirit and scope to the claims.

For instance, although the embodiment is described about an example of applying the present disclosure to the monochrome printer 1 as shown in FIG. 1, the disclosure is not restricted to this. Needless to say, the disclosure may be applied to another image forming apparatus including the charge roller and cleaning brush, such as a monochrome copying machine, a digital copying machine, a color printer or a facsimile.

Moreover, although the above-mentioned embodiment is described about an example of using the roller-formed cleaning brush, the disclosure is not restricted to this. For instance, another cleaning brush having another main body part made of a rectangular plate may be used.

In addition, a timing of cleaning the protrusion of the surface of the charge roller may be for every time of completing the printing operations or at a time when a number of the prints reaches to a predetermined number.

Furthermore, in order to change the distance between the charge roller and main body part of the cleaning brush, although the above-mentioned embodiment is described about an example of moving the main body part of the cleaning brush, the charge roller may be moved.

What is claimed is:

1. An image forming apparatus comprising:

an image carrier;

a charge roller configured to include a surface having protrusions and depressions and to electrically charge the image carrier;

a cleaning brush configured to include a brush part cleaning the surface of the charge roller and a main body part supporting the brush part, in which the brush part includes a top end part and a belly part being nearer to the main body part than the top end part; and a distance changing mechanism configured to change a distance between the charge roller and main body part of the cleaning brush so that, by adjusting the distance between the charge roller and main body part to a first distance, the top end part of the brush part contacts with the depression of the surface of the charge roller and, by adjusting the distance between the charge roller and main body part to a second distance shorter than the first distance, the belly part of the brush part contacts with the protrusion of the surface of the charge roller.

2. The image forming apparatus according to claim 1, wherein, the distance between the charge roller and main body part is changed in a non-printing operation.

3. The image forming apparatus according to claim 2, wherein, the distance between the charge roller and main body part is changed to the first distance in a printing operation.

4. The image forming apparatus according to claim 3, wherein, immediately after a printing operation is completed, the distance between the charge roller and main body part is changed from the first distance to the second distance.

5. The image forming apparatus according to claim 1, wherein the cleaning brush is made in a roller form, and the distance changing mechanism includes a bearing supporting a roller shaft formed in the main body part of the cleaning brush and a solenoid moving the bearing.

* * * * *